United States Patent [19]

Deschand

[11] 4,193,222

[45] Mar. 18, 1980

[54] AUDIBLE AND LUMINOUS SWINGABLE TOY

[76] Inventor: Eugene A. Deschand, 148 N. Grand Ave., Bradley, Ill. 60915

[21] Appl. No.: 931,850

[22] Filed: Aug. 7, 1978

[51] Int. Cl.[2] ..... A63H 5/00; C09K 3/00

[52] U.S. Cl. ..... 46/52; 46/175 R

[58] Field of Search ..... 46/52, 51, 47, 49, 175 R; 340/321; 362/34; 252/188.3

[56] References Cited

U.S. PATENT DOCUMENTS

| | | | |
|---|---|---|---|
| 596,643 | 1/1898 | Weingard | 46/52 |
| 680,703 | 8/1901 | Devaney | 46/52 |
| 729,891 | 6/1903 | Pierce | 46/52 |
| 2,004,817 | 6/1935 | Linney | 46/52 |
| 2,561,179 | 7/1951 | Carney et al. | 46/52 |
| 2,608,025 | 8/1952 | Miller | 46/9 |
| 2,826,862 | 3/1958 | Shapiro | 46/52 |
| 3,325,940 | 6/1967 | Davis | 46/52 |
| 4,044,499 | 8/1977 | Toler | 46/51 |
| 4,086,723 | 5/1978 | Srowick | 362/34 |
| 4,106,079 | 8/1978 | Drury | 362/34 |

*Primary Examiner*—Russell R. Kinsey
*Assistant Examiner*—Michael J. Foycik, Jr.
*Attorney, Agent, or Firm*—Lockwood, Dewey, Alex & Cummings

[57] ABSTRACT

A swingable toy for creating audible vibratory noises and concentric circles of light. First and second elongate end pieces are perpendicularly secured at opposite ends of a tubular central body portion. Noise-emitting vibratory rubber bands are disposed in a parallel and spaced apart relationship between slots disposed in the first and second end pieces. A stabilizing fin is secured to the tubular body portion in a plane perpendicular to that defined by the rubber bands for maintaining the rubber bands in perpendicular relationship to another plane defined by the swinging orbit for maximum vibratory excitement of the rubber bands. A cord is attached to one end of the tubular body through a metal eyelet and a low friction ball bearing is disposed in the cord to relieve twisting of the cord during swinging of the toy for maintaining the rubber bands in a plane perpendicular to that of the swinging orbit.

12 Claims, 6 Drawing Figures

AUDIBLE AND LUMINOUS SWINGABLE TOY

BACKGROUND OF THE INVENTION

This invention relates in general to swingable toys which provide audible vibratory noises and illumination, and more particularly to such a toy with a stabilizing fin mounted on the body of the toy for orientation of noise-emitting vibratory members relative to an orbit defined by the swinging body and a low-friction ball bearing disposed in the cord to relieve twisting in the cord due to swinging of the toy such that the noise-emitting vibratory members are oriented and remain in a plane perpendicular to that of the swinging orbit for improved vibratory effects.

Swingable toys are generally known to the prior art. Some of these toys cause a light mounted in a body member or the like to illuminate by action of centrifugal forces when the toy is whirled. Other whirl toys have utilized bands or other vibratory members, but have not provided any means for maintaining the bands in an orientation which enhances the vibratory sound-emitting effectiveness of the toy. Many such toys do not provide any means for changing the tones emitted by the vibratory members. While whirling in an orbit, the prior art toys are continually twisting or rotating about the cord to relieve twisting in the cord associated with whirling of the toy. This twisting continually orients the vibratory members at changing angles with respect to the orbit of the whirling toy with associated variations in the vibratory exitation of the toy. It has also been common to use a tied loop of the cord for holding on to the toy. Such loops have a danger of becoming untied with consequent loss of control of the toy. On other occasions, handles have been used at the end of the cord, but safety has not been significantly increased by such handles due to the wearing of the cord at the handle or due to the handle slipping out of the hand of the player.

A principal object of the present invention is therefore to provide a novel and improved audible and luminous swingable toy which orients and maintains the vibratory members in a plane perpendicular to that of the orbit of the toy for maximum sound-emitting effectiveness of the vibratory members.

A related object is to provide a stabilizing fin means mounted along a central body portion of the toy for orientation of the vibratory members in a plane perpendicular to that of the orbit.

Another object of the present invention is to provide a low-friction twist relieving means in the cord of the toy such that twisting of the cord associated with whirling of the toy is relieved in the cord and the orientation of the toy by the stabilizing fin means is maintained and enhanced.

Yet another object is to provide slots for inserting, removing or adjusting the vibratory members such that different vibratory members may easily be used in the toy or the tension in the vibratory members may be easily adjusted for different tonal effects.

A further object of the present invention is to provide an audible and luminous swingable toy which exhibits a higher degree of safety than heretofore possible. To this end, a novel gripping member is provided for the end of the cord. The gripping member is held in the palm of the hand and has finger receiving apertures for receiving fingers of the player therethrough. The gripping member also minimizes wear on the cord caused by operation of the toy.

An additional object is to provide a tubular and hollow central body portion adapted for insertion therein of a source of light, such as in a chemiluminescent liquid, and further providing light-emitting materials at spaced points along the cord of the toy for creating concentric circles of light during whirling of the toy for interesting visual effects, in addition to the audible effects.

SUMMARY OF THE INVENTION

These objects and advantages of the invention, and others, including those inherent in the invention, are accomplished by providing an audible and luminous swingable toy adapted for swinging in an orbit, including an elongate and tubular central body portion of transparent or translucent material with light-emitting means disposed in the body portion, first and second elongate end pieces secured at opposite portions of the central body portion in generally perpendicular relationship thereto, a plurality of apertures provided in the first and second end pieces at spaced points therealong for insertion therein of a plurality of vibratory members, with the vibratory members disposed between the first and second end pieces in generally parallel and spaced apart relationship. Stabilizing fin means are disposed perpendicularly to a plane defined by the vibratory members for orienting and maintaining the vibratory members in a generally perpendicular relationship to another plane defined by the orbit. Cord means is attached to one end of the central tubular body portion and twist relieving means is disposed in the cord means to relieve twisting in the cord associated with whirling of the toy, the twist relieving means further aiding the stabilizing fin means in maintaining the orientation of the toy for maximum excitation of the vibratory members. A gripping device is specially shaped to be held in the hand of the player and has finger receiving means for positively receiving fingers of the player therethrough to avoid accidentally losing control of the toy especially while whirling of the same. The gripping device internally secures the cord and a flared cord passageway opening is contoured to minimize wearing of the cord.

BRIEF DESCRIPTION OF THE DRAWINGS

The features of the present invention, which are believed to be novel, are set forth with particularity in the appended claims. The invention together with the further advantages thereof, can best be understood by reference to the following description taken in conjunction with the accompanying drawings, and the several fingers in which like reference numerals identify like elements, and in which:

DESCRIPTION OF THE PREFERRED EMBODIMENT

Figure 1:
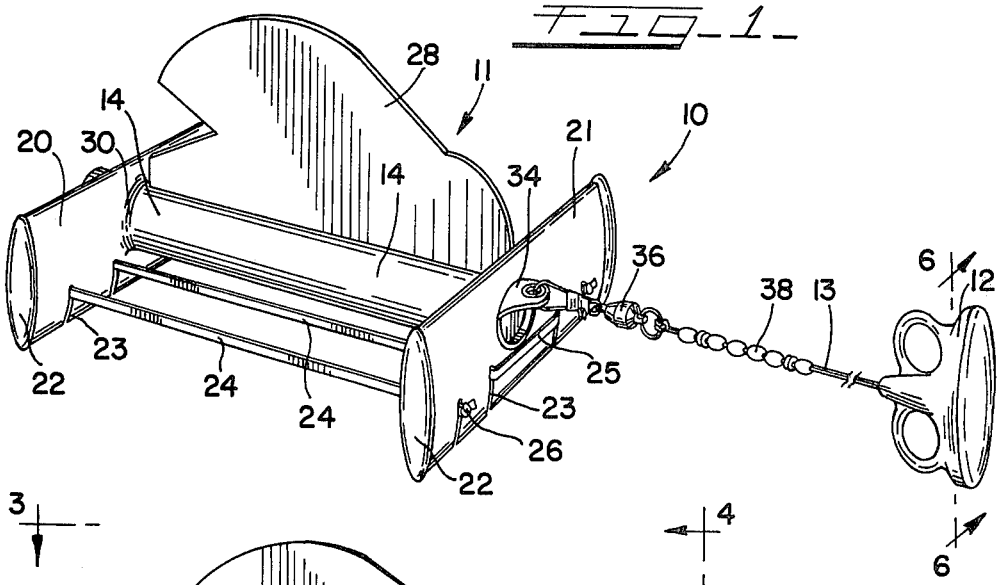
FIG. 1 is a perspective view illustrating the audible and luminous swingable toy in accordance with the present invention, including a gripping member at an opposite end of a cord from a body of the toy.

Referring to FIG. 1, there is illustrated an audible and luminous swingable toy, generally designed 10, including a toy body, generally designated 11, and a gripping member 12 with cord means 13 connected between the toy body 11 and the gripping member 12.

Figure 2:
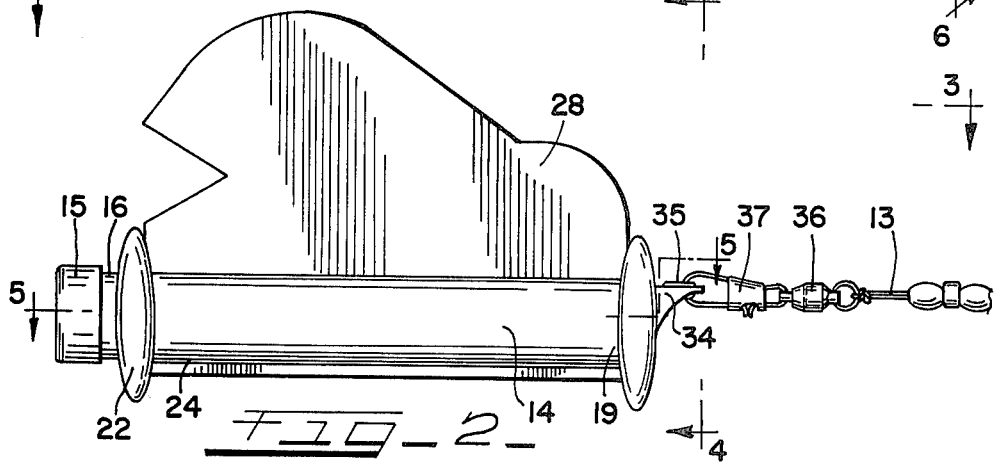
FIG. 2 is a side elevational view of a portion of the audible and luminous swingable toy illustrated in FIG. 1.

The toy body 11 includes an elongate and tubular central body portion 14 which is hollow and preferably closed at both ends. The body portion 14 will typically be about six inches (approximately 15 cm) long. An end cap 15 (FIGS. 2, 3 and 5) is threadedly secured to a first end 16 of the tubular body portion 14 and is removable for insertion in the hollow tubular body portion 14 of a source of light, such as a Cyalume (a trademark of the American Cyanamid Company) light stick which is a chemiluminescent source of light and is commercially available from the American Cyanamid Company, Bound Brook, N.J. 08805. More conventional light sources, such as a lamp and batteries (not shown), could also be inserted into tubular body portion 14.

Respectively rigidly attached near the first end 16 and at a second end 19 of the central tubular portion 14 are transversely extending first end piece 20 and second end piece 21. The tubular body portion 14 preferably intersects the first and second end pieces 20, 21 near the midpoints of the end pieces 20, 21 such that the toy body 11 is symmetric and balanced about the tubular body portion 14. The first and second end pieces 20, 21 have ends that terminate in enlarged lobes 22 which esthetically enhance the appearance of the toy body 11 and which tend to minimize any physical damage resulting from impact of the toy body 11 due to the relatively larger area of the lobes 22 in comparison with the transverse cross sectional area of the end pieces 20, 21. The lobes 22 are of elliptical shape in longitudinal cross section and circular shape in transverse cross section. The body 11 typically has a minimum weight of at least four ounces such that wind currents do not seriously alter the orbit defined during swinging of the body 11.

A plurality of slotted apertures 23 are provided at spaced points along one side of the first and second end pieces 20, 21. The apertures 23 are at the same relative positions in both the first and second end pieces 20, 21 such that a plurality of vibratory members 24, typically rubber bands or the like, may be inserted into corresponding apertures 23 between the end pieces 20, 21 such that the vibratory members 24 are in generally spaced apart and parallel relationship to each other as well as to the tubular body portion 14.

Figure 3:
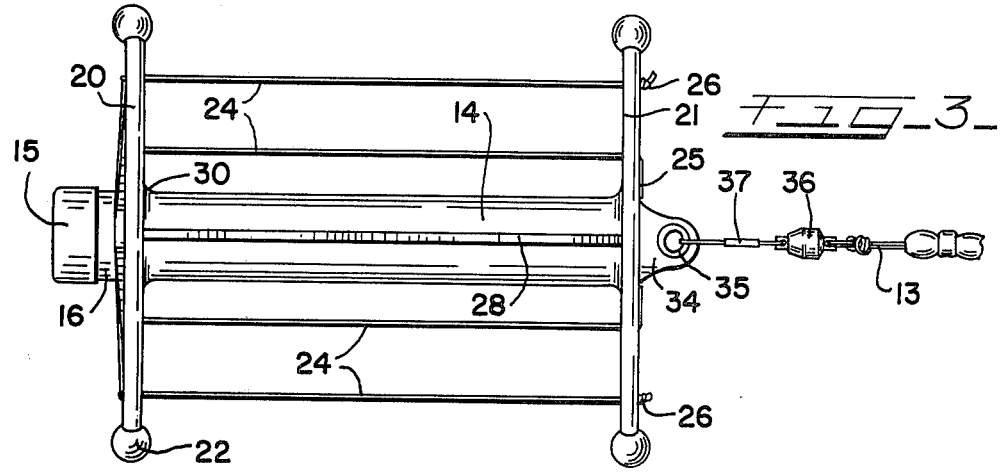
FIG. 3 is a top plan view taken along the line 3—3 of the toy illustrated in FIG. 2.
Figure 4:
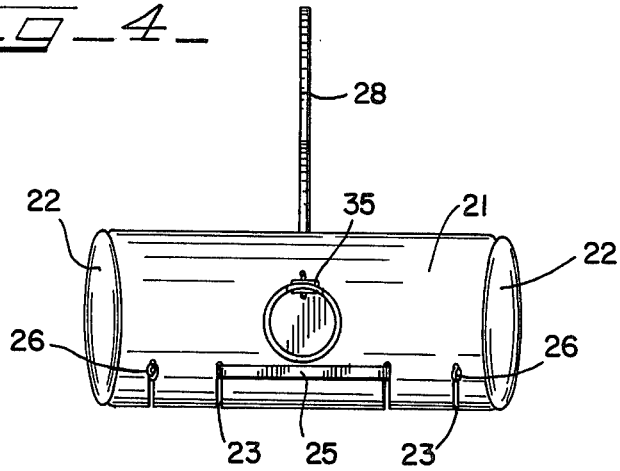
FIG. 4 is a front elevational view of the toy taken along the line 4—4 illustrated in FIG. 2.

It is important not to space the apertures 23 too closely such that adjacent vibrating members 24 interfere with each other. Minimum spacing between adjacent apertures 23 of ½ inch (1.8 cm) should be observed. Separate vibratory members 24 may be placed between corresponding slotted apertures 23 in the first and second end pieces 20, 21, or a continuous vibratory member 24 may be threaded through the various apertures 23. Combinations of continuous and single vibratory members 24 may be also utilized with the vibratory members 24 having differing physical characteristics or being under differing degrees of tension for the production of different audible sound tones. Where a continuous vibratory member 24 is used between at least two pairs of apertures 23, it will be readily appreciated that the tension in that portion of the vibratory member extending between one pair of apertures 23 may be simply adjusted to change the tonal qualities of that portion of the vibratory member 24 by providing greater or less tension therein, as by moving or relocating a portion 25 (FIGS. 1 and 4) of the vibratory member 24 located between apertures 23 along the same end piece 21. Ends of the vibratory member 24 may be tied in a knot 26 for securement in and against the aperture 23. In adjusting tension in the vibratory members 24, portions thereof may also be wound around the first end 16 of the tubular body portion 14 which extends through the first end piece 20 as seen in FIG. 3. The vibratory members 24 will continue to produce audible sounds so long as the toy body 11 is whirled in an orbit with the volume bearing relation to the angular velocity of the body 11.

In accordance with one of the aspects of the invention, a stabilizing fin means 28 is longitudinally disposed along the tubular body portion 14 between the first and second end pieces 20, 21. In accordance with the invention, it is important that the fin means 28 be generally perpendicular to a plane defined by the vibratory members 24 such that the fin means 28 will be effective in orienting the toy body 11 during swinging thereof in an orbit such that the vibratory members 24 will be oriented in a plane generally perpendicular to that defined by the orbit. It is desirable that the vibratory members 24 be positioned in this relationship during whirling of the toy body 11 for maximum vibrational excitation by the air. Without an effective stabilizing fin means 28, the toy body 11 would tend to twist while swung in the orbit due to the continual twisting in the cord means 13 caused by swinging the toy 10 in its orbit. If the toy body 11 were permitted to twist, at times the vibratory members 24 would be in planar alignment with the orbit and air currents about the vibratory members 24 and the tubular body portion 14 would tend to disturb air currents around other vibratory members 24 thereby lowering the excitation of the members 24 and the audible output thereof. In stabilizing and orienting the toy body 11, the stabilizing fin means 28 has a minimum effective surface area defined by the equation $A=\frac{1}{4}L^2$ where L is the length along the tubular body portion 14 between the first end piece 20 and the second end piece 21. The surface area of the fin means 28 can of course be greater than this minimum requirement. The fin means 28 can assume various shapes and preferably has an irregular shape such as that illustrated in FIGS. 1 and 2 for an interesting appearance.

Figure 5:
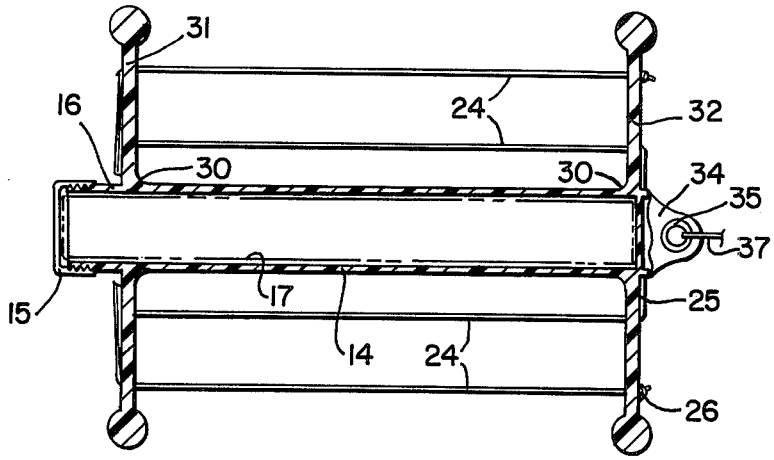
FIG. 5 is a sectional view of the toy taken along the lines 5—5 in FIG. 2, but with a modified form of end pieces for supporting the vibratory members therebetween, further illustrating the structure of the toy.
Figure 6:
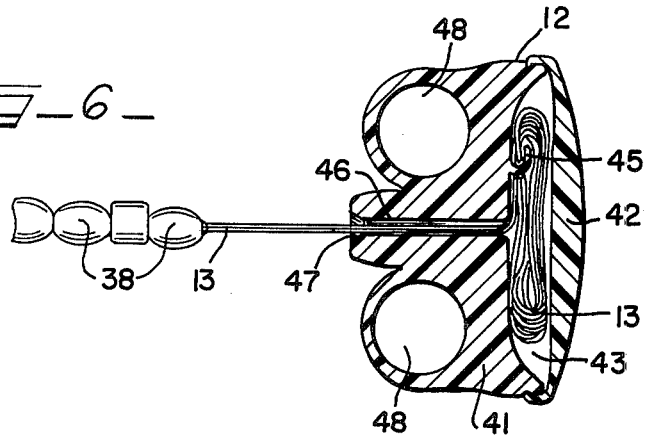
FIG. 6 is a sectional view of the gripping member taken along the line 6—6 of FIG. 1.

The body portion 11, including the central tubular portion 14, the first and second end pieces 20, 21, the enlarged lobes 22 and the end cap 15 can all easily and economically be fabricated from thermoplastic materials by known molding techniques. All of these elements of the toy body 11 are preferably fabricated from translucent or transparent thermoplastic materials for the most advantageous conductance and dispersion of light from the light source 17 for illumination of the entire toy body 11. For best light conductance and diffusion in the end pieces 20, 21, said end pieces preferably have an oval or elliptical transverse cross sectional shape and the tubular body portion 14 intersects the first and second end pieces 20, 21 in a smooth and continuous surface 30 (FIGS. 1, 3 and 5). For this reason, the embodiment illustrated in FIGS. 1 through 4 is considered the preferred embodiment of the invention. However, satisfactory light transmission can also be achieved in the embodiment illustrated in FIG. 5 wherein respective first and second end pieces 31, 31 have the shape of a single flat bar of material. Curved and continuous intersections 30 are also used between the tubular body portion 14 and the end pieces 31, 32 of the flat configuration.

A tab member 34, which is an integral extension of the tubular body portion 14, extends through the second end piece 21 (FIGS. 1 and 3) or 32 (FIG. 5) and is provided with a metal eyelet 35 for securement of the cord means 13 therethrough. For better orientation of the toy body 11, the tab member 34 is preferably located on the same side of the tubular body portion 14 as the fin means 28 which is on an opposite side of the tubular body portion 14 from the vibratory members 24.

The cord means 13 includes a high strength and flexible cord, such as a braided nylon cord of approximately 120 pound test rating. A low friction ball bearing 36 is disposed in the cord means 13, and a quick-disconnect securing element 37 detachably connects the cord means 13 through the metal eyelet 35 of the toy body 11. The bearing 11 relieves any twisting in the cord means 13 due to swinging of the toy 10 in a circular orbit to aid the fin means 28 in maintaining the vibratory members 24 in the aforedescribed positional relationship to the orbit.

Groups of beads 38 made of a radium-doped thermoplastic material for emission of visible light in dim lighting conditions are preferably disposed at spaced points along the cord means 13 for creating concentric circles of light and for decorative purposes. Glowing of the beads 38 may be recharged by placement of same in proximity to any bright light.

In accordance with another aspect of the invention, there is provided a gripping member 12 for securing the end of the cord means 13 opposite from the toy body 11 for whirling of the toy 10 with a high degree of safety. The gripping device 12 includes a body 41 and a removable cover 42 which is snappingly received by the body 41. Defined between the body 41 and the cover 42 is a recess or cavity 43 containing a prong or other securent means 45 for the cord 13. Excess cord means 13 may be stored in the cavity 43 with the prong 45 securing the desired length of cord means 13. A passageway 46 extends between the internal cavity 43 and a flared opening 47 on an exterior surface of the gripping device 12. The cord means 13 extends through the passageway 46 into the internal cavity 43. The flared opening 47 of the passageway 46 preferably has contoured surfaces, generally in the shape of a bell, to minimize wear of the cord means 13 against the opening 47 during whirling operation of the toy 10. Formed on opposite sides of the passageway 46 are a pair of finger receiving apertures 48 for receiving a pair of fingers of the player therethrough. The entire gripping device 12 is sized and shaped to fit in the closed palm of the player with the players' fingers extending through the apertures 48 such that it is nearly impossible for the gripping device 12 to accidentally slip out of the operator's hand. The gripping device 12 may also be easily and economically fabricated from thermoplastic materials by known molding techniques.

Various portions of the body 11 may alternatively or additionally be painted with fluorescing paints for illumination under so-called "black" or ultraviolet light.

It will be understood that various changes and modifications may be made without departing from the spirit of the invention as defined in the following claims, and equivalents thereof.

I claim:

1. An audible and luminous swingable toy for swinging in an orbit, said toy comprising:

an elongate and tubular central body portion, said body portion being of transparent or translucent material;

light emitting means disposed in said tubular body portion for illuminating the body portion;

a first elongate end piece secured to said body portion near one end thereof in generally perpendicular relationship thereto;

a second elongate end piece secured to said body portion near an opposite end thereof in generally perpendicular relationship thereto;

a plurality of apertures in said first and second end pieces at spaced points therealong;

a plurality of vibratory members disposed in said apertures between said first and second end pieces such that said vibratory members are in generally parallel and spaced apart relationship, said vibratory members adapted to emit audible noise frequencies upon excitation by air currents while swinging in said orbit;

stabilizing fin means disposed perpendicularly to a plane defined by said vibratory members for orienting and maintaining said vibratory members perpendicular to another plane defined by said orbit;

cord means attached to one end of said central tubular body portion; and twist relieving means disposed in said cord means to relieve twisting in said cord means such that said vibratory members tend to remain oriented in a plane perpendicular to the plane defined by said orbit.

2. The audible and luminous toy of claim 1 wherein said stabilizing fin means and said first and second elongate end pieces are of a transparent or translucent material for illumination by said light emitting means.

3. The audible and luminescent swingable toy of claim 1 wherein said light emitting means comprises a chemical luminescent material.

4. The audible and luminous swingable toy of claim 1 wherein an end of said tubular body portion extends through said second end piece, said toy further comprising an end cap releasably securable to the end of the body portion extending through the second end piece for removing or replacing said light emitting means in said tubular body portion.

5. The audible and luminous swingable toy of claim 1 wherein said first and second elongate end pieces are elliptically shaped in transverse cross-section and extreme ends of the first and second end pieces terminate in enlarged lobes.

6. The audible and luminous swingable toy of claim 5 wherein said tubular body portion is secured to said first and second end pieces about midpoints thereof.

7. The audible and luminous swingable toy of claim 1 wherein said stabilizing fin means comprises a generally planar fin having a minimum area equal to $\frac{1}{4}L^2$ where L is the length of the tubular body portion between said first and second end pieces.

8. The audible and luminous swingable toy of claim 1 wherein said vibratory members comprise rubber bands.

9. The audible and luminous swingable toy of claim 1 wherein said cord means are attached to one end through a metal eyelet disposed in said central tubular body portion and said twist relieving means comprises a low-friction ball bearing.

10. The audible and luminous swingable toy of claim 1 further comprising light-emitting means disposed at spaced points along said cord means for creating concentric circles of light while said toy is swinging in said orbit.

11. The audible and luminous swingable toy of claim 1 further comprising gripping means including means for securing said cord means and finger receiving means defined in said gripping means adapted to receive a players' fingers therethrough for positively holding said gripping means.

12. The audible and luminous swingable toy of claim 11 wherein said gripping means further comprises a body with said finger receiving means defined therein, a cover snappingly securable to said body and defining an internal cavity therebetween, said cord holding means disposed in said internal cavity, a passageway communicating between said internal cavity and an exterior surface of said body and adapted to receive said cord means therethrough, and a portion of said bore at said exterior surface being flared to minimize the wear of said cord means thereat.

* * * * *